US006279453B1

(12) United States Patent
Funck

(10) Patent No.: US 6,279,453 B1
(45) Date of Patent: Aug. 28, 2001

(54) HIGH-PRESSURE SYSTEM

(75) Inventor: Theodor Funck, Göttingen (DE)

(73) Assignee: Resonic Instruments GmbH (DE)

( * ) Notice: Subject to any disclaimer, the term of this patent is extended or adjusted under 35 U.S.C. 154(b) by 0 days.

(21) Appl. No.: 09/381,157

(22) PCT Filed: Mar. 13, 1998

(86) PCT No.: PCT/EP98/01489

§ 371 Date: Nov. 16, 1999

§ 102(e) Date: Nov. 16, 1999

(87) PCT Pub. No.: WO98/41761

PCT Pub. Date: Sep. 24, 1998

(30) Foreign Application Priority Data

Mar. 14, 1997 (DE) ..... 197 10 717

(51) Int. Cl.[7] ..... F16J 1/10
(52) U.S. Cl. ..... 92/129; 92/161; 403/374.4
(58) Field of Search ..... 92/129, 161; 403/109.5, 403/304, 314, 316, 322.2, 368, 374.4

(56) References Cited

U.S. PATENT DOCUMENTS

| | | | | |
|---|---|---|---|---|
| 2,727,466 | * | 12/1955 | Kling et al. | 92/128 |
| 4,331,883 | * | 5/1982 | Vitaloni | 307/150 |
| 5,494,414 | | 2/1996 | Steinhart | 417/360 |
| 5,656,034 | | 8/1997 | Kochersperger | 604/155 |

FOREIGN PATENT DOCUMENTS

| | | |
|---|---|---|
| 0751059 | 1/1997 | (EP) . |
| 694342 | 12/1930 | (FR) . |
| 2744175 | 8/1997 | (FR) . |
| WO9502764 | 1/1995 | (WO) . |

* cited by examiner

*Primary Examiner*—Edward K. Look
*Assistant Examiner*—Thomas E. Lazo
(74) *Attorney, Agent, or Firm*—Baker Botts LLP

(57) ABSTRACT

A high-pressure apparatus with driving device (10) and pressure generating device (30) has a frame configuration (20) through which the driving device and the pressure generating device are connected but detachable (FIG. 1A).

6 Claims, 6 Drawing Sheets

Figure 1A:
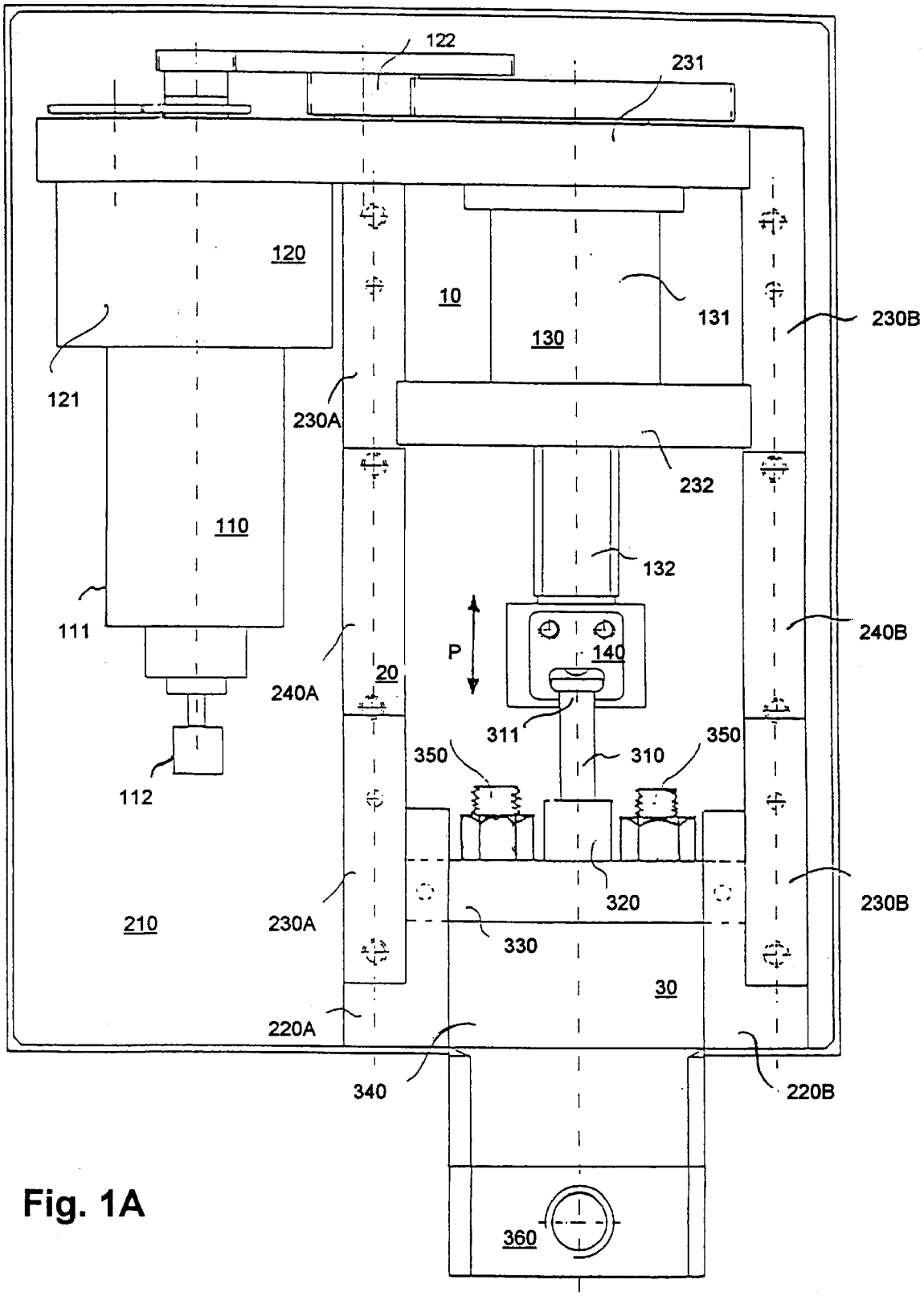

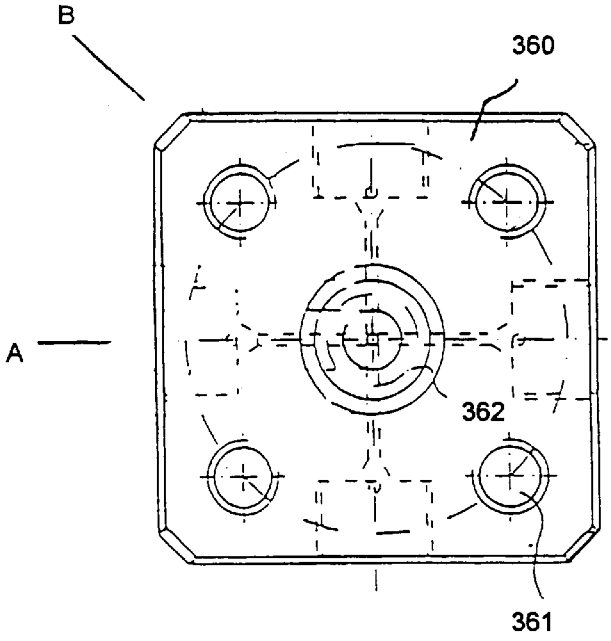
Fig. 6A
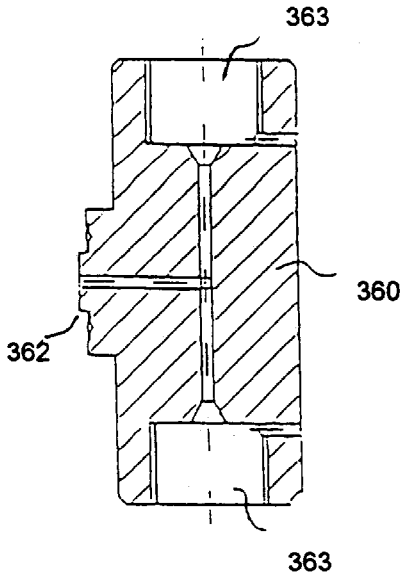
Fig. 6B Schnitt A

HIGH-PRESSURE SYSTEM

The invention relates to an apparatus for generating high pressure in a hydraulic fluid, in particular a cylinder/piston pressure device.

It is generally known (for example U.S. Pat. No. 2,727,466, U.S. Pat. No. 4,331,883, U.S. Pat. No. 5,494,414 and FR-A-614 342) that a pressure medium in a cylinder can be subjected to pressure to generate high pressure in pressure systems, eg for engineering processes or experimental purposes. The pressure piston is operated with a drive motor, by which the piston position in the pressure cylinder and thus the pressure in the hydraulic fluid can be set by suitable means for power transmission. In such a generic high-pressure apparatus, consisting of a drive unit and a high-pressure unit, the drive and high-pressure units must be firmly connected to guarantee safe and reproducible power transmission. The highest demands are made of the stability of the connection since in practical applications take-up of thrust must be ensured corresponding to values of 1 to 2 tonnes.

Because of the power transmission that is called for and for reasons of operating safety, conventional high-pressure apparatus is generally designed so that the drive and high-pressure units are firmly connected using elaborate technical means or constructed as an integral unit.

The interconnection of the components of conventional high-pressure apparatus is a disadvantage because operation of the high-pressure apparatus is restricted to a pressure range defined by the size of the particular pressure cylinder. If different pressure ranges, i.e. different active cylinder volumes, are required for a particular application, the corresponding number of high-pressure apparatuses has to be provided. Furthermore, operation of a high-pressure apparatus calls for regular maintenance of the high-pressure packings, especially the piston sealing. Disassembly of the high-pressure apparatus for maintenance purposes is impractical for the user. Because for maintenance the entire high-pressure apparatus has to be disassembled by a specialist costing time and money. These disadvantages mean that the range of use of conventional high-pressure apparatus is limited.

The object of the invention is to provide an improved high-pressure apparatus with which the disadvantages of conventional high-pressure apparatus can be overcome and that features, in particular, simplified handling, simplified maintenance and an extended range of use whilst guaranteeing high accuracy and reproducibility of the pressure setting.

This object is solved by a high-pressure apparatus with the features of patent claim 1. Advantageous embodiments of the invention are defined in the dependent claims.

According to the invention the driving device and pressure generating device of a high-pressure apparatus are linked together by a frame configuration being formed so that both components are detachable and can easily be separated from one another in a pressure relieved state. The frame configuration is designed so that a fixed stop is formed in relation to a direction of power transmission (especially in the direction of thrust for pressure build-up) so that the driving device and pressure generating device are permanently positioned in relation to one another. The frame configuration is also designed so that the two components can be freely moved and separated in a direction other than that of transfer of force. The direction of power transmission and the separating direction preferably form an angle equal to or less than 90°. So the stop is formed of an essentially rectangular box or for the most U-shaped with one side open in the separating direction.

In a pressurized state the connection between the driving device and pressure generating device in the direction of power transmission is secured by the stop and in the separating direction by the friction influenced by the forces released in thrust. The driving and pressure generating devices are then clamped together in relation to the separating direction.

In a preferred embodiment of the invention the driving device is firmly (permanently) linked to the frame configuration, while the pressure generating device is detachably joined to the frame configuration. Thus the driving device forms a non-disassemblable unit to which the pressure generating device can be joined as needed by simple means.

The embodiment and advantages of the invention are described in what follows with reference to the attached drawings which show:

FIG. 1A a schematic plan view of a high-pressure apparatus according to the invention (without safety housing)

Figure 1B:
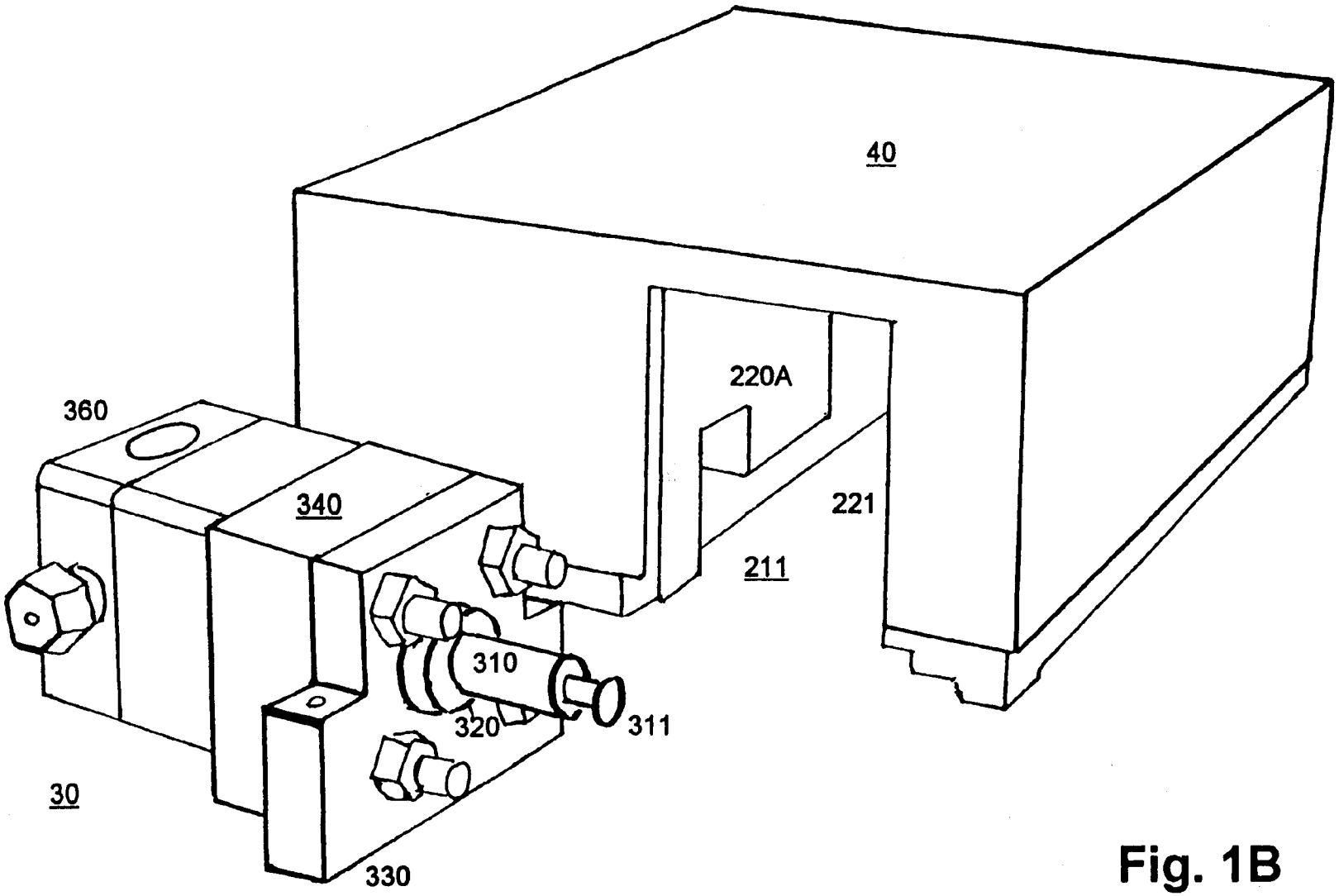
Figure 2A:
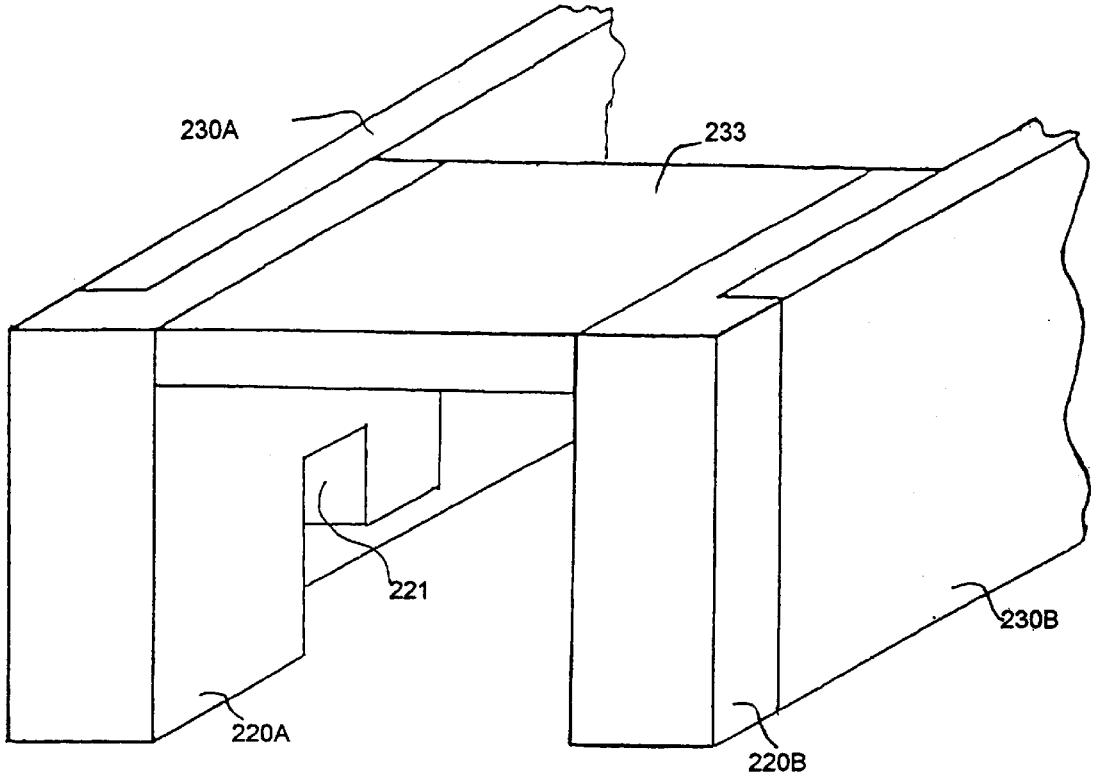
Figure 2B:
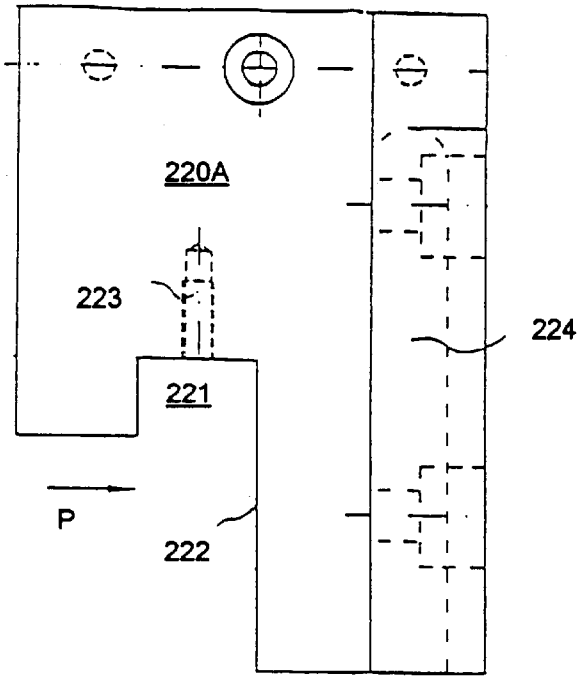
Figure 3:
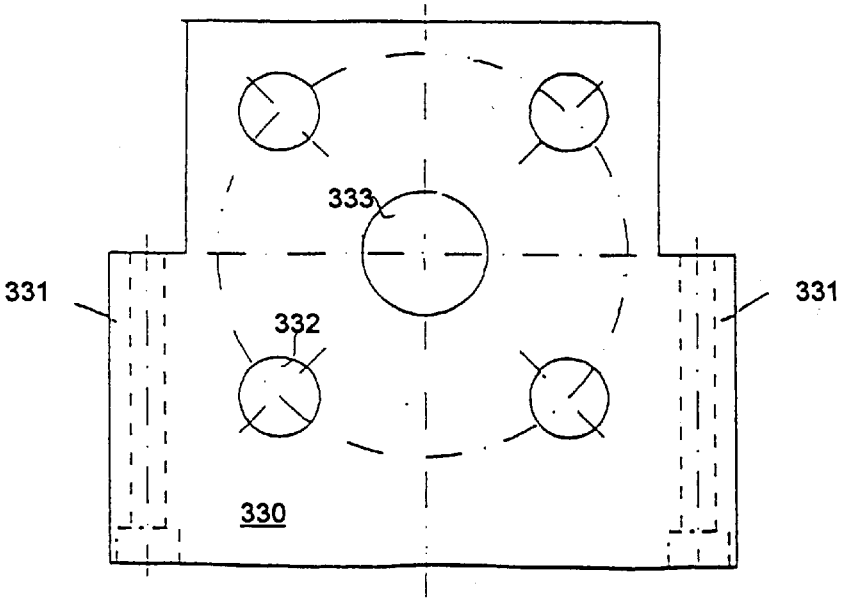
Figure 4:
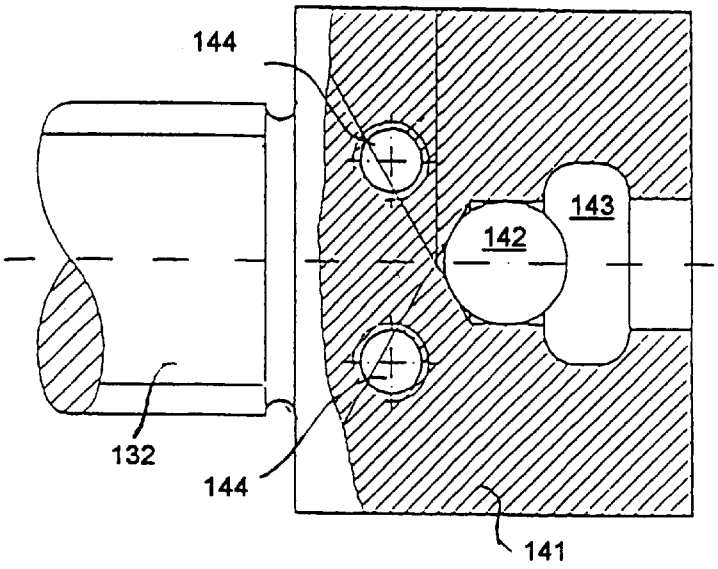
Figure 5:
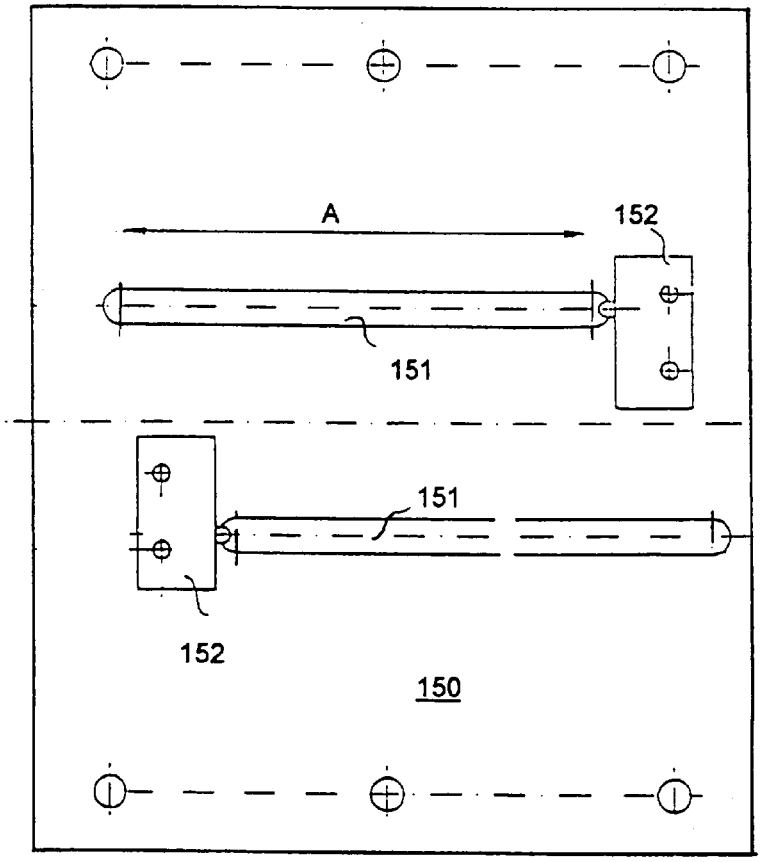

FIG. 1B a perspective of the high-pressure apparatus (with safety housing) according to the invention with the pressure generating device removed, FIG. 2A a perspective of a holding block provided in a high-pressure apparatus according to FIG. 1 to hold the pressure generating device, FIG. 2B a side view of part of the holding block according to FIG. 2A, FIG. 3 a plan view of a pressure plate of the pressure generating device provided for mating with holding blocks according to FIG. 2, FIG. 4 an enlarged, partly sectional plan view of the driving device of a ball-and-socket joint configuration as shown in FIG. 1, FIG. 5 a plan view of a limit switch plate that interacts with the ball-and-socket joint configuration according to FIG. 4, and FIGS. 6A, 6B views of a pressure distributor head intended for the pressure generating device.

As an embodiment of the implementation of the invention, a cylinder/piston pressure device with a motor drive is described in what follows that is intended for pressure experiments with extreme demands for accuracy and reproducibility. The invention is not restricted to such a pressure device, however, instead it can be used in all generic high-pressure apparatus.

The high-pressure apparatus according to FIG. 1A comprises a drive unit or driving device 10, a frame configuration 20 and a pressure unit or pressure generating device 30, accommodated together in a closed safety housing (not shown). FIG. 1A is a schematic from the upper side of the high-pressure apparatus showing the individual components and how they are arranged on the baseplate 210. The baseplate 210 has a recess 211 intended for access to the pressure generating device 30 (see below).

FIG. 1B is a schematic overall view of the high-pressure apparatus with the safety housing 40, the pressure generating device 30 of the high-pressure apparatus being shown separately and removed.

The driving device 10 (according to FIG. 1A) comprises a motor drive 110, a gear configuration 120, a spindle configuration 130 and a ball-and-socket joint configuration 140 intended for power transmission to the pressure generating device 30.

The motor drive 110 includes a DC motor 111, on whose shaft an encoder device 112 is provided. The encoder device 112 allows detection and control of the motor position and thus of the pressure generated (see below). Operation of the high-pressure apparatus is preferably computer-aided.

The gear configuration 120 forms a means of increasing the torque and reversing the direction of the shaft. Reversal of the shaft is a major advantage for the compactness of the high-pressure apparatus according to the invention. The torque gearing is necessary to convert the torque, primarily produced by the DC motor 111, to a higher torque that allows generation of the required pushing forces on the ball-and-socket joint 140 through the spindle configuration 130. The gear configuration 120 comprises a planetary gearing 121 and a stepdown gearing 122.

In the spindle configuration 130 following the stepdown gearing 122 the rotary motion of the motor drive is converted into a translatory motion of the ball-and-socket joint configuration 140. For this purpose the spindle configuration 130 comprises a spindle nut 131 that is firmly or frictionally connected to the take-off gear wheel of the stepdown gearing 122 and is flexibly packed by ball bearings in the traverses 231 and 232 of the frame configuration 20, and the spindle screw 132.

Attached at the end of the spindle screw 132 is the ball-and-socket joint configuration 140, details of which are described below with reference to FIG. 4.

The frame configuration 20, intended according to the invention for separable joining of the driving device 10 and the pressure generating device 30, is formed by parts of the baseplate 210 (so-called cheek), the holding blocks 220A, 220B, the holding or side walls 230A, 230B (or support plate), the traverses 231, 232 and the joint plate 233. All of these parts are firmly connected and form the frame configuration to absorb the forces produced in the generation of pressure. Between the holding walls 230A, 230B and the holding blocks 220A, 220B the baseplate 213 has a recess 211 to allow access from the outside (from below in the standing position) to the ball-and-socket joint configuration 140 and the pressure generating device 30 without having to open the housing (see FIG. 1B). The connections are preferably formed of screws. Details of the holding blocks 220A, 220B are explained below with reference to FIGS. 2A, 2B and 3. The side walls 230A, 230B each have a recess 240A, 240B to hold a limit switch plate 150 (see FIG. 5).

The pressure generating device 30 includes a cylinder/piston pressure device, of which FIGS. 1A and 1B only show the end of the cylinder 320 and part of the piston rod 310, whose end 311 contacts with the ball-and-socket joint configuration 140. The remaining, unillustrated parts of the pressure device (piston head, cylinder, etc) are in the body 340, connected at one end to a pressure plate 330 (see FIG. 3) and at the other pressure delivery end to a pressure distributor 360 (see FIG. 6). This connection is made by several screw bolts, the dimensions of which, considering the required tensile strength, are chosen to hold the pressure plate 330, the body 340 and the pressure distributor 360 securely together during operation. The screw bolts for holding the pressure generating device 30 and the pressure plate 330 together are of steel. Since the remaining parts of the pressure generating device 30 are only pressure stressed, they can be produced of aluminum for example. The pressure plate 330 has shoulders projecting over the outside of the body 340, the purpose of which is explained below with reference to FIGS. 2 and 3. The pressure plate 330 also has several through-holes 332 for the screw bolts and a central opening 333 for the high-pressure cylinder 320. Different to the illustrated design, the pressure plate and the body can also form an integral unit.

FIG. 2A shows a perspective of the end of the frame configuration 20 with the holding blocks 220A, 220B, side walls 230A, 230B and a joint plate 233 (not shown in FIGS. 1A, 1B for the sake of clarity).

FIG. 2B is a side view of the holding block 220A, intended to hold one of the shoulders of the pressure plate 330 of the pressure generating device 30. The holding block 220B serves an analogous purpose. On its under side, ie the side facing the baseplate 210 with the access opening, the holding block 220A has an essentially U-shaped recess 221 into which one of the shoulders 331 of the pressure plate 330 can be inserted for a form-locking match. A side wall 222 of the recess 221 forms a stop for the pressure plate 330 or the thrust transmitted to the pressure plate 330 by the motion of the spindle, ball-and-socket joint and piston in the direction of the arrow P. The two side walls 222 on the two lateral holding blocks 220A, 220B (see FIGS. 1A, 1B) take up the entire shear force transmitted by the driving device to the pressure generating device. Each holding block 220 is provided with an angle 224 that is screwed to the side wall 230. In the bottom of the recess 221 there is a tapped hole 223 to establish a screwed connection with the pressure plate 330. This screwed connection is solely for secure seating of the pressure generating device, without contributing to the transfer of force. Consequently no special requirements for strength are to be made of the screwed connection 223, which is an advantage for easy exchangeability of the pressure generating device 30, as explained in more detail below.

The recess 221 (see FIGS. 1B, 2B) does not extend to the baseplate. Instead the base of the recess 221 is spaced above the baseplate allowing placement of the tapped hole 223 and facilitating alignment of the pressure generating pressure 30 in relation to the ball-and-socket joint configuration 140.

The holding blocks 220A, 220B are attached to the sides 230A, 230B of the frame and to the baseplate 210 so that the front walls 222 of the recesses 221 are exactly in a plane perpendicular to the direction of the compressive force that is produced. The pressure plate 330 engages from below with little play with its side shoulders 331 into these recesses 221 of the holding blocks and is held in this position by two screws. In this way the pressure plate 330 absorbs the forces produced in generating pressure and transmits them through the holding blocks to the frame construction.

The ball-and-socket joint 141 of the ball-and-socket joint configuration 140 (see FIG. 1A) is shown enlarged in FIG. 4 in a view from below, partly as a horizontal section along the middle axis. The ball 142 is set in the middle of the joint 141, at the end of the spindle 132, so that the surface of the ball is exposed on the side facing away from the spindle. The ball surface extends into the recess 143, intended to hold the end 311 of the piston rod 310. This end has a corbelling to whose form the shape of the recess 143 is matched so that engagement is formed through which the piston rod 310 can either be moved forward by the pressure of the ball surface to generate pressure or back through the recess 143 to release pressure.

This recess 143 in the ball-and-socket joint 141 is open on the under side and the end 311 of the piston rod has so much play in the recess that the end of the piston rod can easily be disengaged from the ball-and-socket joint 141 once the connection has been put into a position in which no thrust or pulling force is exerted. To secure the ball-and-socket joint the recess 143 of the ball-and-socket joint configuration 140 is sealed by a cover (not shown) that is screwed to the ball-and-socket joint 141 in the tapped holes 144.

On the closed upper side of the ball-and-socket joint 141, on both sides and square with the direction of motion, there are horizontal arms attached (not shown), on the ends of which there are rollers running in ball bearings. These roller bearings are supported by the limit switch plate 150 attached between the recesses 240A and 240B of the holding walls 230A, 230B and prevent rotation of the spindle 132 in forward or reverse motion.

Also on the upper side of the ball-and-socket joint 141 there are two pins extending vertically upwards that project through two slots 151 of the limit switch plate 150 (shown enlarged in FIG. 5). These slots are aligned in the direction of motion of the spindle and at their opposite ends there are end sensors 152 to cut out motion of the spindle at its end positions.

Another means of power transmission can be used as an alternative to the ball-and-socket joint configuration 140. The ball-and-socket joint configuration 140 is preferred, however, because the ball ensures single-point contact with the end of the piston rod so that there is always a unique relation between the setting of the motor (or the setting of the ball-and-socket joint configuration 140) and the position of the piston 310 (or the pressure in the pressure cylinder). This is of special significance when there are high demands for accuracy and reproducibility. A further advantage of the ball-and-socket joint configuration is that mechanical centering of the piston rod 310 in the pressure generating device 30 is not disturbed by contact with the means of transferring force.

FIGS. 6A and 6B show, by way of example, a pressure distributor 360 that is attached to the pressure generating device 30 and to whose screw terminals 363 it is possible to connect high-pressure lines.

The view from the attachment side (FIG. 6A) shows four tapped blind holes 361 for the screw bolts with which the pressure distributor 360 is joined to the body 340 and the pressure plate 330, and through which at the same time the high-pressure-tight connection of the pressure cylinder 320 is established with the connecting base 362 of the pressure distributor 360. Inside the pressure distributor a hole 364 leads from the connecting base 362 to a number of pressure connectors 363. The section through the pressure distributor 360 in FIG. 6B shows the connecting base 362, the pressure connectors 363 and the holes 364 leading to the pressure connectors.

The pressure generating device 30 forms a high-pressure unit that is easily exchangeable. It can be separated from the driving force 10 with minimum effort and little specialist knowledge, and be detached from the frame configuration 20 without opening the safety housing. The high-pressure unit is removed by first moving the piston to its front end position and then releasing the force lock in the ball-and-socket joint connection by a slight reverse motion. These movements of the pressure piston are best performed automatically by computer control. Then the small part 211 of the baseplate 210 is removed that seals the mounting opening. After this the cover of the recess 143 in the ball-and-socket joint 141 is removed, the two screws loosened that hold the pressure plate 330 in the holding blocks, and the high-pressure unit taken out from below through the mounting opening.

Removal of the high-pressure unit (and insertion in the reverse order) is simple and can be done speedily and securely by any user with few aids, so high-pressure units of different volume can easily be exchanged. Thus it is possible to fit high-pressure units with pressure cylinders for 3.3 ml, 6.6 ml or 10 ml, for example, to produce pressure of 2.5 kbar, 1.6 kbar or 1 kbar.

The simple exchangeability of the high-pressure unit (illustrated in FIG. 1B) is a decisive advantage especially for maintenance of the high-pressure packings. The high-pressure apparatus according to the invention is characterized by high accuracy of the set pressure, so high requirements for accuracy can be made of the apparatus. These requirements can be maintained in longer operation, in the event of defects, by simply exchanging the high-pressure unit. The set pressure remains constant for a number of days. Any drop in pressure is only produced by diffusion processes on the piston packing and amounts to about one part per thousand a day. The compact design and the driving by a DC motor allow simple adaptation of the high-pressure apparatus to very different technical requirements.

An important aspect of the high-pressure apparatus according to the invention is that the detachable components of the frame configuration and the pressure generating device comprise milled parts that can be manufactured on computer-controlled machines with a process accuracy of the order of 10 $\mu$m. This ensures reproducible positioning of the pressure generating device in relation to the driving device with high accuracy. The connections between the individual components of the frame configuration and the driving device are made by screws, avoiding disadvantages produced by other kinds of connection like welding.

The high-pressure apparatus according to the invention is simple to operate on the pressure distributor 360 (see FIGS. 6A, 6B) with the use of a manometer, but may also be provided with computer control, pressure being set on the basis of stored calibration curves and using a signal from a pressure sensor and a position signal of the encoder device 112.

What is claimed is:

1. High-pressure apparatus with driving device (10) and pressure generating device (30) that can be activated by the driving device to generate pressure in a hydraulic fluid, whereby a frame configuration (20) is provided through which the driving device and the pressure generating device have a detachable connection, characterized by the fact that the frame configuration (20) forms a stop for the pressure generating device (30) in relation to a direction of power transmission is such that the driving device (10) and the pressure generating device (30) are positioned immobile relative to one another and in relation to the direction of power transmission, and are arranged freely mobile relative to one another and in relation to another direction differing from the direction of power transmission in pressure relieved state.

2. High-pressure apparatus according to claim 1 in which the frame configuration (20) consists of a support plate (210), holding walls (230A) and (230B), traverses (231) and (232), a joint plate (233) and holding blocks (220A) and (220B) and in which the driving device is integrated force-locking into the frame configuration and the pressure generating device is inserted force-locking in the holding blocks.

3. High-pressure apparatus according to claim 2 in which the driving device and the pressure generating device are arranged in a safety casing with a support plate as the bearer plate of the frame configuration.

4. High-pressure apparatus according to claim 3 in which the pressure generating device (30) comprises a cylinder/piston pressure device that is connected to a pressure plate (330) that is intended for form-locking insertion in the holding blocks (220) and that transmits the compressive force to the frame configuration.

5. High-pressure apparatus according to claim 4 in which the driving device (10) contains a spindle drive (130) with which a piston rod of the cylinder/piston pressure device can be actuated through a detachable ball-and-socket joint configuration (140).

6. High-pressure apparatus according to claim 1 in which the frame configuration forms a U-shaped stop, whereby in balanced state the driving device and the pressure generating device are freely mobile relative to one another in the direction from its open side.

* * * * *

UNITED STATES PATENT AND TRADEMARK OFFICE

CERTIFICATE OF CORRECTION

PATENT NO. : 6,279,453 B1
DATED : August 28, 2001
INVENTOR(S) : Funck

It is certified that error appears in the above-identified patent and that said Letters Patent is hereby corrected as shown below:

Title page,
Item [57], ABSTRACT, line 4, "(FIG. 1A)" should be deleted

Column 1,
Line 33, "apparatuses" should read -- apparatus --
Line 51, "the features of patent claim 1." should read -- a driving device and pressure generating device that can be activated by the driving device to generate pressure in a hydraulic fluid, whereby a frame configuration is provided through which the driving device and the pressure generating device have a detachable connection, characterized by the fact that the frame configuration forms a stop for the pressure generating device in relation to a direction of power transmission is [sic] such that the driving device and the pressure generating device are positioned immobile relative to one another and in relation to the direction of power transmission, and are freely mobile relative to one another and in relation to another direction differing from the direction of power transmission in pressure relieved state. --

Signed and Sealed this

Sixteenth Day of April, 2002

*Attest:*

*Attesting Officer*

JAMES E. ROGAN
*Director of the United States Patent and Trademark Office*